US008500569B2

(12) United States Patent
Moore

(10) Patent No.: US 8,500,569 B2
(45) Date of Patent: Aug. 6, 2013

(54) GOLF SWING TRAINING DEVICE

(76) Inventor: Alexandrea Moore, Raleigh, NC (US)

( * ) Notice: Subject to any disclaimer, the term of this patent is extended or adjusted under 35 U.S.C. 154(b) by 110 days.

(21) Appl. No.: 12/927,686

(22) Filed: Nov. 19, 2010

(65) Prior Publication Data

US 2011/0165955 A1 Jul. 7, 2011

Related U.S. Application Data

(60) Provisional application No. 61/281,670, filed on Nov. 21, 2009.

(51) Int. Cl.
*A63B 69/36* (2006.01)

(52) U.S. Cl.
USPC ..... 473/215; 473/207; 473/227

(58) Field of Classification Search
USPC ..... 473/207, 212–216, 226, 227, 266, 473/277, 422, 458; 482/124, 126
See application file for complete search history.

(56) References Cited

U.S. PATENT DOCUMENTS

| | | | | | |
|---|---|---|---|---|---|
| 2,103,502 | A * | 12/1937 | Webster | ..... | 473/215 |
| 3,858,881 | A * | 1/1975 | Hurwitz | ..... | 473/553 |
| 4,540,173 | A * | 9/1985 | Hopkins, Jr. | ..... | 482/124 |
| 5,062,642 | A * | 11/1991 | Berry et al. | ..... | 473/277 |
| D390,896 | S * | 2/1998 | Stalnaker | ..... | D21/662 |
| 5,813,954 | A * | 9/1998 | Wilkinson | ..... | 482/124 |
| 6,270,430 | B1 * | 8/2001 | Nicoloff | ..... | 473/458 |
| 7,731,597 | B1 * | 6/2010 | Burgess | ..... | 473/215 |
| 2003/0176227 | A1 * | 9/2003 | Czaja et al. | ..... | 473/227 |
| 2007/0131837 | A1 * | 6/2007 | Mizereck | ..... | 248/499 |
| 2007/0232404 | A1 * | 10/2007 | Begert | ..... | 473/216 |

* cited by examiner

*Primary Examiner* — Nini Legesse
(74) *Attorney, Agent, or Firm* — Thomas A. O'Rourke; Bodner + O'Rourke, LLP

(57) ABSTRACT

A training device properly develops a sports equipment swing, particularly for golf equipment, to counter an over-powered back-swing that results in an uncontrolled out-of-plane downswing. The device may comprise a strap having one end secured to a latch plate, and the other end securable to a latch that releasably receives a portion of the latch plate. At least one bungee cord may have one end attached to the strap at a position relative to the latch, being approximately 4-12 inches displaced therefrom. The other bungee cord end may have a cinching device located thereon to adjustably secure the bungee cord therein to engage a golf club shaft or shaft of a sports racquet, bat or stick. The bungee cord may comprise first and second cord portions being joined together, where the first cord portion has a low elastic modulus, and the second cord portion a high elastic modulus.

19 Claims, 7 Drawing Sheets

(Upswing)

FIG. 1
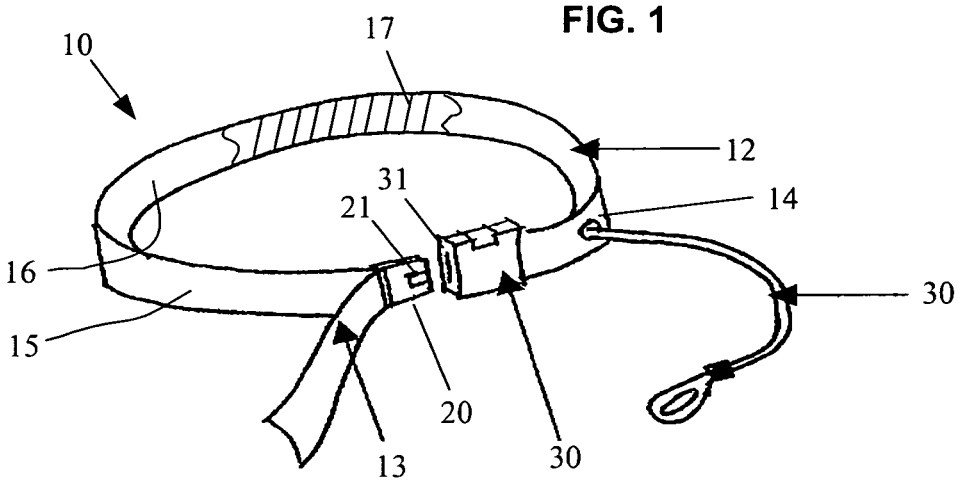
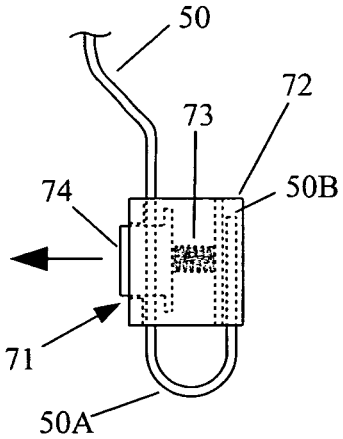
FIG. 1A
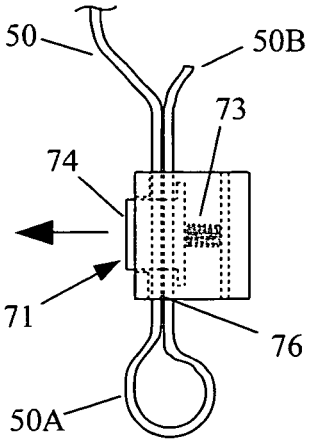
FIG. 1B (Upswing)

(Upswing)

(Upswing)

(Downswing)

(Downswing)

(Downswing)

(Attaching the Training Device to a Golf Club Shaft)

GOLF SWING TRAINING DEVICE

CROSS REFERENCES TO RELATED APPLICATIONS

This application claims priority on U.S. Provisional Application Ser. No. 61/281,670, titled "Golf Swing Training Device," filed on Nov. 21, 2010, the disclosures of which are incorporated herein by reference.

FIELD OF THE INVENTION

The present invention relates to improvements in devices which are conducive to improving a golfer's swing, and more particularly to an apparatus which is capable of providing a simpler means of improving a golfer's downswing to be in-plane and with correct club rotation and/or muscle memory.

BACKGROUND OF THE INVENTION

Although the governing body of golf today in the U.S. is the United States Golf Association (USGA), the first "13 Rules of Golf" were written in 1774. Because of the level of difficulty required to master the game, or to at least be able to play with some level of proficiency, golf equipment was quickly developed to improve a golfer's score, and in many cases, this playing equipment would substitute for the skill of the golfer. Rules were quickly added to control the use of equipment, and maintain the fairness of the game, so that the golfer's main advantage would be attributable to his/her degree of skill. Today, restrictions on equipment are found in the USGA rules, particularly rule 2, and appendix II, regarding the design of golf clubs.

With many limitations being placed on the type of equipment a golfer may utilize to better his or her score during a round of play, the efforts and innovation for achieving such improvements have been directed towards developing the golfer's technique. While good golfing technique comprises many different aspects, including correct ball positioning, proper club grip, a good stance, and several other facets that come into play before the golfer is actually ready to attempt to strike the ball, chief among the fundamentals requiring proper development is the mechanics of the golfer's swing.

A proper golf swing comprises a double pendulum swing, with the first pendulum corresponding to the golfer's shoulders and arms, and the second pendulum corresponding to the golfer's wrist, hands, and the golf club. Many inventions have been produced, which are directed to training the golfer to complete a proper double pendulum swing. For example, U.S. Pat. No. 3,319,963 to Cockburn for "Golf Swing Guiding Device Including Correct Swing Indicator." The Cockburn device comprises a multi-arm, multi-pivoting machine that is designed to constrain the golfer's swing of the club "through the correct arc of movement during the upswing and down-swing." Although the machine appears well adapted to such training, the machine itself is quite bulky, and furthermore requires a pillar, support post, or a wall onto which the machine may be attached. U.S. Pat. No. 2,737,432 to Jenks, U.S. Pat. No. 3,415,523 to Boldt, and U.S. Pat. No. 5,474,299 to Romano offer similar devices, with similar drawbacks.

However, one of the predominant swing problems that golfer's frequently experience is having a downswing being out-of-plane, and having incorrect club rotation. Devices offering similar aids to train the golfer's swing, while simultaneously affording greater mobility in the locations where training may occur, are found in several related patents.

U.S. Pat. No. 6,994,633 to Czaja discloses a chest harness from which extends an inelastic flexible strap that connects to the golfer's golf club to help replicate the double pendulum swing, with the flexible strap serving to help the golfer maintain the proper swing radius. But the device does not serve to counter the out-of-plane swing and club rotation problems.

U.S. Pat. No. 5,188,365 to Picard for a "Golf Swing Training Harness" discloses an attachment means to be secured to the golfer's waist, one elbow on one side of the golfer, and one knee and one wrist on the golfer's opposite side. The elbow attachment means is connected by an elastic extensor to a respective side of the waist attachment, while the wrist attachment means on the opposite side of the golfer is connected by an elastic extensor to a respective side of the waist attachment means, and is also connected by another elastic extensor to the knee attachment means. The elbow extensor holds the elbow in close proximity to the torso, the wrist extensor "encourages the stiff left arm of the golfer to remain 'tight' at the top of the backswing, rather than being too far back or too far forward," while the leg-wrist extensor encourages proper inward and rearward movement of the golfer's knee. The Picard device does also serve to develop proper muscle memory to counter the out-of-plane swing problem, however, in addition to working multiple other swing-deficiency areas which may not be problematic for a particular golfer, make much of the device overly restrictive and counter-productive, the elastic extensor disclosed lacks the sophistication necessary for achieving proper swing mechanics throughout all portions of the golfer's swing—back-swing and down-swing. The extensors are only and very simply described as being "suitable flexible elastic materials . . . "

A golfer's training device that is somewhat more adept at countering the problem is shown by U.S. Pat. No. 3,804,420 to Boyd. The Boyd training device consists of a cord being wound around a helical groove in a spring-loaded reel and having one end secured thereto, with the assembly being stored in a housing. The housing is secured to a waist band, while the free end of the cord that protrudes from the housing is secured to a glove that is worn on the hand of the golfer's leading arm. As the golfer moves his arms in the back-swing, he/she is "made aware of an increasing tension on his left or leading hand." However, a constantly increasing pressure is not consistent with the optimum mechanics necessary to produce good muscle memory for a proper in-plane downswing. Moreover, with the Boyd training device, the golfer must inconveniently move his elbow at the peak of the upswing to contact a release plate, in order to release the reel to have the spring urge rotation of the reel, and relieve tension on the cord. The deficiencies of each of the prior art devices, with respect to training muscle memory for a proper in-plane down-swing with correct club rotation, is eliminated in the simple device disclosed in the present invention.

OBJECTS OF THE INVENTION

It is an object of the invention to provide a swing training device to be usable with sports equipment that must be directed through consistent backward and forward swing motions, including tennis, badminton, and racquetball racquets, baseball bats, and particularly golf clubs.

It is another object of the invention to provide a golf swing training device that is adapted to create good muscle memory in a golfer of a proper swing.

It is a further object of the invention to provide a training device that is adapted to foster a proper in-plane down-swing for a golfer.

It is also an object of the invention to provide a device capable of slowing down and controlling a backswing in preparation for reversing direction.

It is another object of the invention to provide a training device that simultaneously trains correct club rotation during a golfer's downswing.

Further objects and advantages of the invention will become apparent from the following description and claims, and from the accompanying drawings.

SUMMARY OF THE INVENTION

The swing training device disclosed herein may be used to properly train the biomechanical dynamics of a person's swing and to aid in the correction of common swing problems. The device may be used with any piece of sports equipment having a handle and shaft arrangement that must be articulated through a planar back-swing-forward-swing motion, such as for use with a golf club, tennis racquet, a badminton racquet, a racquet ball racquet, and even for a baseball bat. Where the device is used in combination with a golf club, it may advantageously solve common golf swing problems—namely, an overpowered backswing resulting in an uncontrolled, 'off-plane' downswing. It also trains the correct club rotation during the downswing. The device includes a secure belt worn by the trainee with a 'resistance-band'made of non-rigid elastic material including but not limited to bungee-cord, rubber, or similar elastic polymeric rope-like material permanently attached to one side of the belt on one end of the cord- and the other end of the cord is temporarily attached (for the training session) to the golf club shaft just below the handle with a fastening means.

On the belt, the resistance band is non rigid and is preferably attached off-center approximately 6 inches nominally—but can be 0 to 18 inches from the center of the buckle (i.e., buckle centered on the front of the user's body)—optimally offset to the opposite side of the person's hand. Therefore, if a person is right-handed—the resistance-band will be optimally offset toward the trainee's left side, and vice versa. The device can also be positioned with the resistance-band centered on the front of the user's body, according to the preference of the user. The user can adjust the resistance by rotating the position of the buckle on the body. For example, the buckle can be moved about 90 degrees from the center of the front of the body to increase the resistance. In another embodiment where the user is putting or performing a chip shot, the user may have the buckle at his or her side i.e., about 90 degrees from the position at the front center of the body thereby moving the anchor position of the resistance band to the back of the body.

The length of the 'resistance band' and the resistance offered by the band are other important factors, and they may be made to be user variable or dependent in advanced models of the device. When used during a training session, the resistance-band will attenuate the trainee's upswing thereby teaching the person's 'muscle-memory' the feeling of slowing down and controlling the backswing in preparation for reversing direction for a controlled, smooth, naturally 'on-plane' downswing. The tension energy then loaded into the resistance-band at the top of the backswing by virtue of its pulling effect will teach a person's 'muscle-memory' to correctly accelerate into the downswing while remaining naturally 'on-plane.' Attachment of the resistance-band to the club shaft just below the grip provides a lever-arm effect—pulling the club rotation forward around the fulcrum of the wrist thereby providing a training means for the correct rotational positioning of the club-head toward the ball as it is hit. This is also one of the key and unique features of this invention.

BRIEF DESCRIPTION OF THE DRAWINGS

FIG. 1 is a perspective view of a first embodiment of the golf swing training device of the current invention.

FIG. 1A is an enlarged view of the club attachment means of the training device of FIG. 1.

FIG. 1B is an alternate embodiment of the club attachment means of the training device of FIG. 1A.

DETAILED DESCRIPTION OF THE INVENTION

Figure 2:
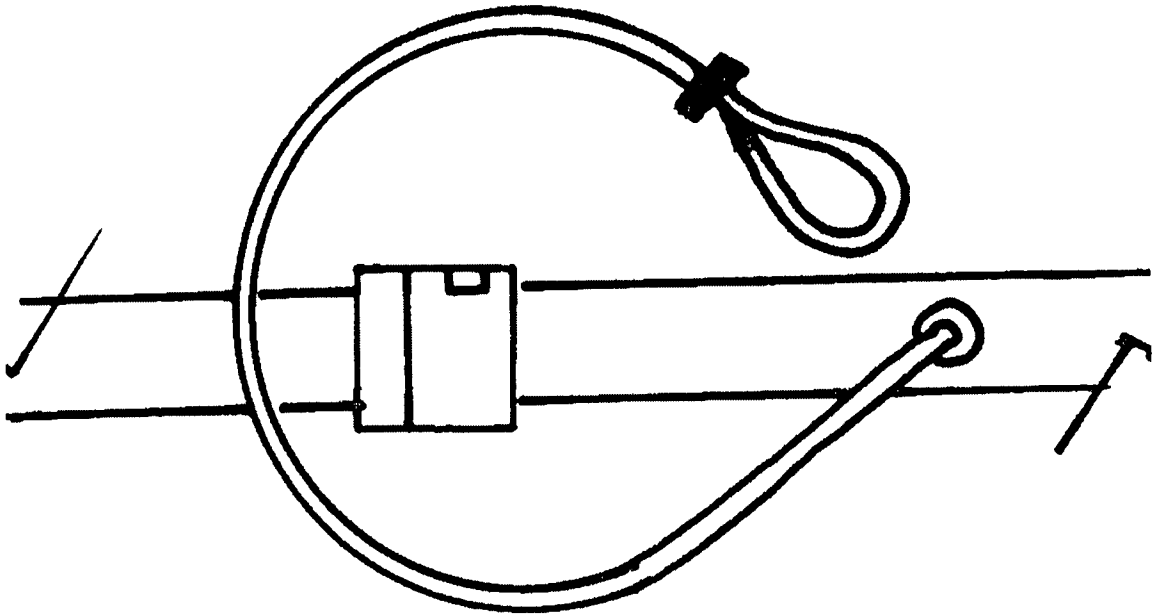
FIG. 2 is a front view of a first alternate embodiment of the golf swing training device, including a wrap-around elastic resistance band.
Figure 3:
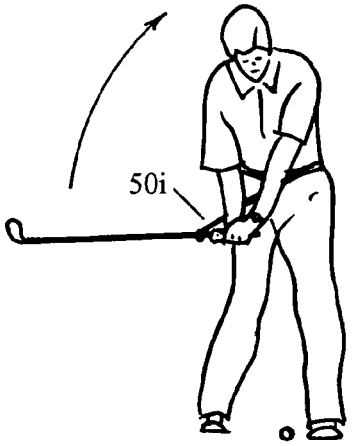
FIG. 3 is a front view of a golfer using the golf swing training device of FIG. 1, while the golf club is at an early portion of the upswing.
Figure 4:
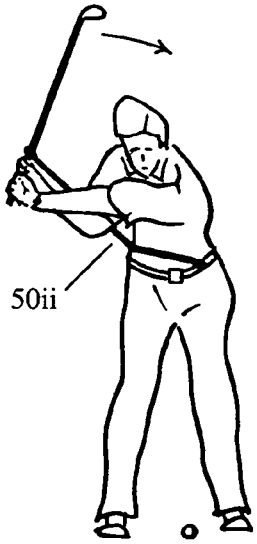
FIG. 4 is a front view of a golfer using the golf swing training device of FIG. 1, while the golf club is at a middle portion of the upswing.

FIG. 1 shows a first embodiment of the training device 10 of the present invention. Training device 10 may be comprised of a strap 12, which may be made of any suitably flexible material having sufficient strength to be securable to the latch and latch plate, as hereinafter described. The material may preferably be a woven nylon, and one or more layers of woven material may be utilized in forming strap 12.

A buckle which may include a latch plate 20 and latch 30 may be used in combination with the strap 12 to form a belt. One end of the strap 12 may be fed into one or more slots in the latch plate to produce a protruding strap excess 13, which may be grasped and pulled upon to adjust the size (perimeter) of the belt. Another end of strap 12 may be secured to latch 30, with the belt then comprising an outside surface 15 and an inside surface 16 that may contact a person's waist. Details of the latch plate and latch may be comparable to, or in conformance with, those found in expired U.S. Pat. No. 4,870,726 to Eksell, expired U.S. Pat. No. 4,232,433 to Ueda, and expired U.S. Pat. No. 4,196,500 to Happel, the disclosures of each being incorporated herein by reference, as possible alternate embodiments of the latch and latch plate. Other possible alternate embodiments may include a belt that is a unitary member, and which may be placed over the person's head and slid down to the user's waist, with the belt possibly exhibiting elastic qualities to accommodate various sized users. In another alternate embodiment, the belt may include a buckle that is adapted to secure in a friction fit, the strap of the belt, without the use of a latch plate. In a still further alternative embodiment the strap may have a first end and a second end that are secured together by a securing means such as Velcro.

Operation of the latch plate and latch simply requires insertion of the free end of the latch plate 20 into the side opening 31 in the latch plate, with the opening 21 of the latch plate 20 being releasably secured therein in accordance with the prior art. A rubber pad 17 may be incorporated onto the inside 16 of the belt's strap 12, and may be secured therein using adhesive, or threading, or any other suitable attachment means known in the art. The rubber pad 17 may be usable to provide a level of comfort to the user's waist while the belt is secured thereabout, as the device 10 may be utilized for a significant amount of time to train the golfer's swing and develop good muscle memory.

The current invention features at least one elastic resistance band arrangement extending from a portion of the belt, for use in combination with the golfer's club. In the first embodiment, shown in FIG. 1, the elastic resistance band arrangement may comprise a single elastic resistance band 50 that may be secured to a portion of the belt, being securable to either the latch 30 or a portion of the strap 12, preferably being near the center of the width of the strap. In one embodiment, a first end of the elastic resistance band 50 may be securable to the strap 12 through an opening in the strap, which may be reinforced using a grommet 14, which may be a metal grommet. The first end of the elastic resistance band 50, in the case of using only one resistance band, may be secured to the inside surface 16 of strap 12, using one or more of adhesive, threading to sew the resistance band to the strap, adhesive and threading in combination with sandwiching the end of the resistance band between rubber pad 17 and strap 12, or by using any other clamping/affixing means known in the art.

A total length of the elastic resistance band 50 may protrude from the grommet 14, which is discussed in further detail hereinafter, and which terminates in club shaft attachment means 70. The club attachment means 70 is shown enlarged in FIG. 1A, and includes a cinching apparatus 71. The cinching apparatus may be similar to one that is commonly used in clamping up upon drawstrings of outerwear and the like. The cinching apparatus 71 may comprise a housing 72 with a clamping member 74 being slidably disposed within a cavity of the housing, and being biased by a spring 73 to have a portion of the clamping member contact the housing. A portion of the clamping member 74 may protrude from the housing 72 to be usable as a button 75 to actuate the clamping member, to permit adjustments to the effective length of the elastic resistance band 50—the length stretching between the user at the attachment to the strap and the connection at the golf club. With the button 75 being depressed, the elastic resistance band 50 may enter one opening on a side of housing 72 and pass between the housing and the clamping member to exit another opening on an opposite side of the housing. A small portion of the elastic resistance band 50 may form a loop 50A, with the second end 50B of the resistance band being secured to a portion of the housing 72. With this arrangement, adjustment to the size of the loop 50A may be achieved by depressing button 74, and by drawing back upon the long portion of elastic resistance band 50 to decrease the size of the loop.

A second embodiment of the cinching apparatus is shown in FIG. 1B, in which the second end 50B of the elastic resistance band is not secured to the housing 72 of the cinching apparatus 71, and instead is looped around post 76 of housing 72, and fed back through the two openings to exit where it initially entered the housing 72. In this arrangement, two different adjustments are possible. First, the loop 50A size may be adjusted as before, wherein the button 74 may be depressed to relieve pressure from the elastic resistance band 50 and then by drawing back upon the long portion of elastic resistance band to decrease the size of the loop. A second adjustment is also possible, which may be to the length of the elastic resistance band running from the strap 10 to be secured to the golf club. This adjustment may also be made by first depressing the button 74 to relieve pressure from the elastic resistance band 50, and then, to decrease the length, by feeding in some of the long portion of resistance band 50, to increase the size of loop 50A, and then by pulling on the second end 50B to shrink the size of the loop. In a third embodiment of the resistance band, shown in FIG. 2, the free end 50B may extend all the way back to strap 10 to be secured just as the first end, which would result in a doubling of the resistance capability of the band. Design of the resistance band is discussed in detail hereinafter.

Figure 9:
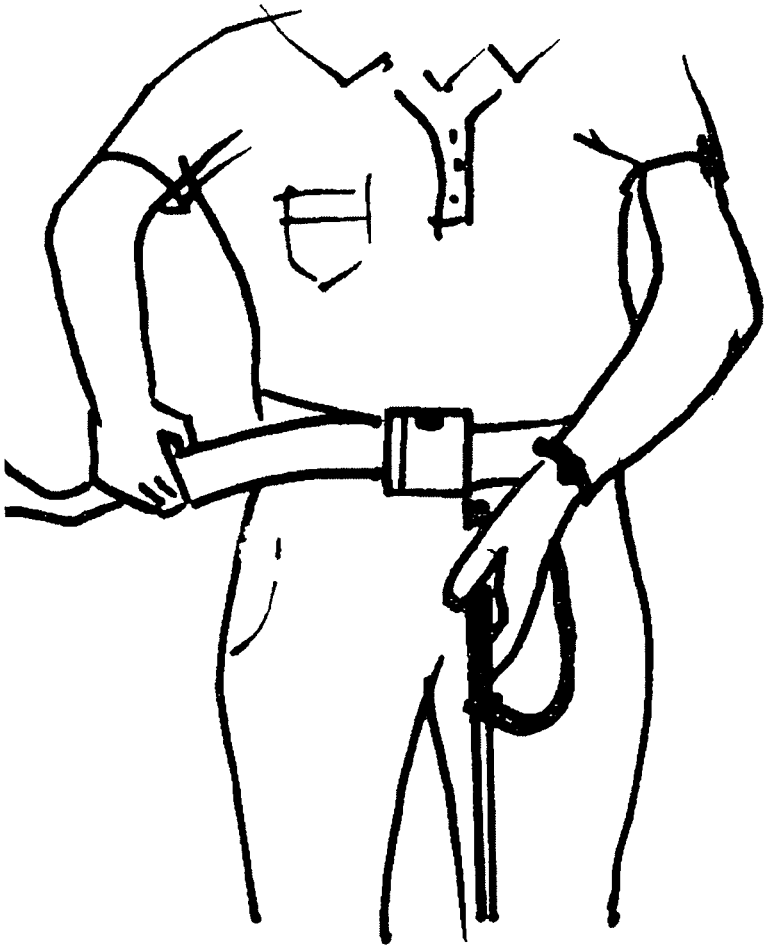
FIG. 9 is a front view of a golfer latching and adjusting the golf swing training device of the current invention around her waist.
Figure 10:
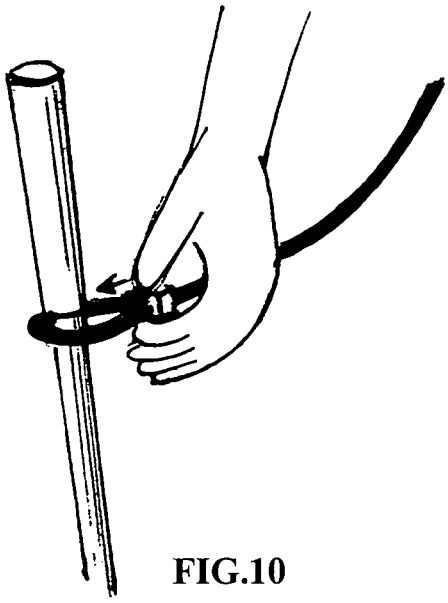
FIG. 10 is a front view showing latching and adjusting of the golf club attaching means of the current invention to a user's golf club.

Use of the golf swing training device 10 may be seen initially in FIG. 9, as the golfer wraps the strap 10 of the device around her waist, clamps the latch plate 20 into the latch 30, and adjusts the tightness of the strap about her waist by pulling sufficiently on the strap excess 13. Next, as seen in FIG. 10, the user of the device 10 may take the loop 50A of the club shaft attachment means 70 and place the loop over the end of the golf club shaft and slide it down to a portion of the handle/shaft that will be beyond the point where the golfer's hands may grip the handle (see also FIGS. 3-8). Once properly positioned, the user may depress the button 74 of the cinching apparatus 71 and pull on the elastic resistance band 50 to shrink the loop 50A to snugly engage the golf club shaft.

The golfer may now grip the club handle as he or she would ordinarily do, and assume a proper golfer's stance whereby the golfer addresses the ball. Once properly positioned, the golfer is set to begin to move the club, seeking to master movement of the club through the correct swing plane, and striving to be able to do so repetitively. It is important to note that the user of the golf swing training device disclosed herein may find advantageous use during practice swings aimed solely at developing muscle memory, where the user has no intention of playing immediately thereafter; or during practice swings just prior to actually taking a golf shot, where the golfer removes the device before his/her actual swing to strike the ball; or the user may utilize the device during actual play when the golfer intends to strike the ball.

Figure 11:
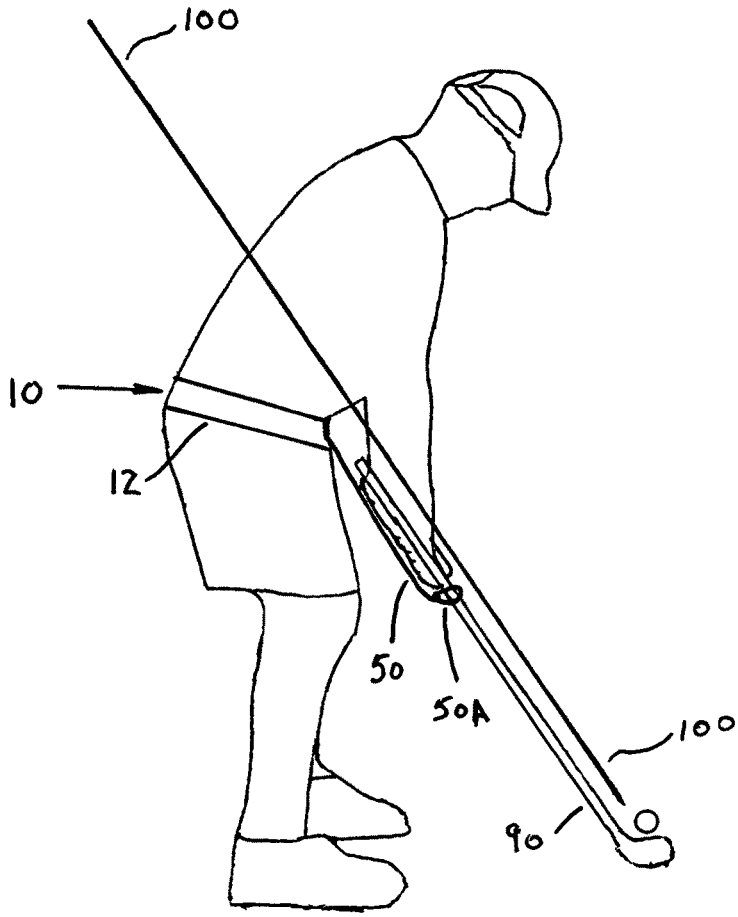
FIG. 11 is a rear view of the golfer shown in a stance to properly address the ball, with the natural "swing plane" shown symbolically with a sold line.

The golfer's swing plane 100 is illustrated in FIG. 11. The swing plane, in a properly executed golf swing, which is most easily seen by observing golfers on the PGA tour, may simply be observed to be the club's movements appearing to be in a perfect diagonal line that runs across their body. The direction of the line is formed by the angle of the club shaft, and by the maneuvering of the golfer's body, so that the club shaft moves in an imaginary line in the view of FIG. 11, which is actually a plane in three dimensional space. The club shaft ideally will remain within that plane during the backswing and downswing.

Figure 12:
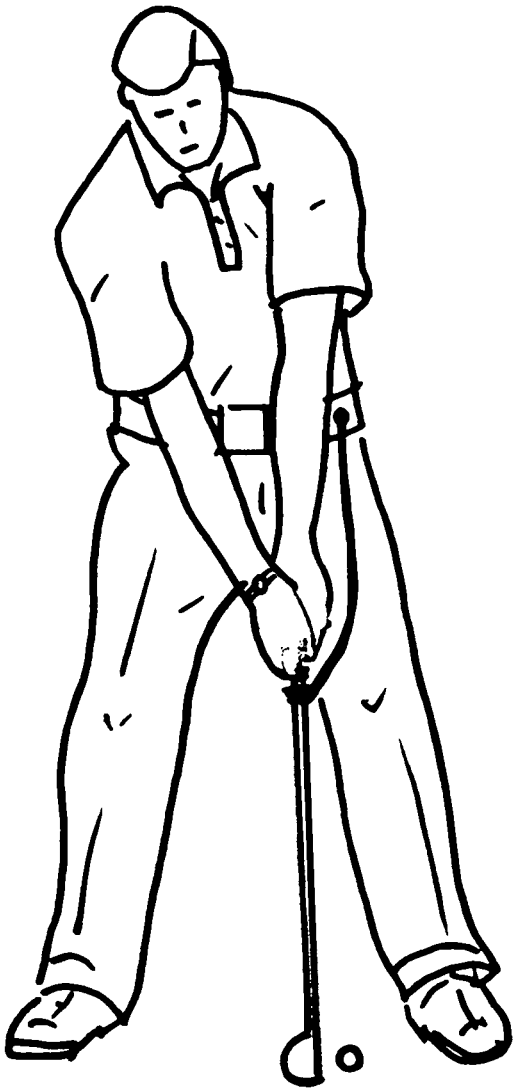
FIG. 12 is a front view of the golfer of FIG. 11.

The beginning of the golfer's swing is illustrated in FIG. 12. For drivers and long irons, the proper stance typically involves the ball being located just inside the lead foot (left foot for right-handed golfers), but certainly at least being located partially off-center towards the lead foot, as illustrated for the golfer in FIG. 12. This stance suggests that optimal attachment of the elastic resistance band 50 to strap 10 be approximately 4-12 inches off-center from the latch plate 20 and latch 30 combination, which may typically be centered upon the golfer's waist (FIG. 9). However, the elastic resistance band 50 may be located anywhere on the strap 10 to conform to the user's particular stance, including being secured to the latch 30. In practice, it is possible for the attachment point of the resistance band to the strap of the belt to be positioned anywhere on one-half of the circumference of a user's waist. So for a user having a 36 inch waist, the elastic resistance band may theoretically be secured across the approximately 18 inch span of the forward facing side of the user, with it possibly being disposed 9 inches in either direction of the latch. As seen in FIG. 12, for a right-handed golfer, the elastic resistance band connection to the strap may preferably be disposed to the left-side of the golfer's waist, whereas for a left-handed golfer, the connection may preferably be disposed to the right side. The device is therefore advantageously used by both left-handed and right-handed golfers. In one embodiment the device may be used by both a left-handed and right-handed golfer. In this embodiment the strap arrangement for a right handed golfer may be inverted thereby rendering it usable by a left-handed golfer.

Looking at the series of images of the stages of the golfer's swing, shown in FIGS. 3-8, it may be seen that as the golf club begins the back swing (FIG. 3), the elastic resistance band 50 may progressively extend from an un-deflected condition, which may be roughly 8 to 14 inches in length, depending upon the golfer's height and arm length, and the position at which he/she extends his grasp of the club handle to address the ball. This leads to the formation of two potentially different embodiments: a first embodiment in which there may be an excess in the length of the resistance band at the outset, with stretching occurring at some point during the user's backswing; and a second embodiment in which the length of the un-stretched elastic band is adjusted to be close to the length necessary for the user to address the ball, with little or no excess (FIG. 11). In this second embodiment, stretching of the elastic member may begin at or very soon after the user's backswing begins. This latter embodiment, with little or no excess, better serves to reinforce the techniques of the present invention by initially exerting a small, but noticeable resistance force. The amount of force exerted by the resistance member is another feature of the present invention, and unlike similar devices found in the prior art, it may be uniquely tailored to vary so as to correspond to the different stages of the golfer's swing. This tailoring is disclosed in more detail later in the specification, since a general discussion of the design of the elastic resistance band 50 is first necessary.

The elastic resistance band 50 may simply be an elongated natural or synthetic rubber, or polymeric member. Natural rubber exhibits unique extensibility, in that it possesses the ability to stretch to about six times that of its original unstretched length. It also correspondingly exhibits excellent resilience by being able to regain its original shape, and excellent tensile strength, meaning the ability to extend under loading without breaking. But, natural rubber degrades with exposure to ultraviolet light and only has fair resistance to air, whereas synthetic rubber materials, such as neoprene, exhibit better resistance to air and sunlight, but have less resilience and tensile strength than natural rubber.

Because of the repetitive usage of the training device 10 and its contact with the user, the elastic resistance band 50 may more suitably be a bungee cord, which may be manufactured in accordance with U.S. Military Specification Mil-C-5651D, "Cord, Elastic, Exerciser and Shock Absorber, For Aeronautical Use," the disclosures of which are incorporated herein by reference. The bungee cord may also be manufactured according to other standards found to be satisfactory. For instance, bungee cords for bungee jumping typically may have a covering made of high tenacity nylon, and not cotton, which is specified in the Mil-Spec. The actual design of the cord-including the cross-sectional area—may be determined according to the back-swing strength of the typical golfer, and may further be in accordance with the technical paper written by J. W. Kockelman and M. Hubbard, which is titled "Bungee Jumping Cord Design Using a Simple Model," (available at http://www.springerlink.com/content/4547h21q5q8q4004/fulltext.pdf), the disclosures of which are incorporated herein by reference.

Bungee cords may be braided, or unbraided, and they may be pre-stretched or un-stretched. Pre-stretching serves to prevent the cord from elongating as much during a bungee jump, and provides a jerking action or a 'bounce,' as the cord becomes fully extended.

Therefore, in an alternate embodiment of the training device 10 of the current invention, the elastic resistance band 50 may comprise two or more sections of cord being joined together, with each having different tensile capabilities. The first portion of cord, being closest to the club shaft attachment means 70, may preferably be designed to elongate first, as the golfer goes from the position of FIG. 11, where he/she is simply addressing the ball, to the backswing positions of FIGS. 3 and 4. As the first cord portion 50*i* may approach its maximum designed cord elongation, the second cord portion 50*ii*, which may be designed to have greater spring stiffness or modulus of elasticity, E, may then begin to elongate. It should be noted that the modulus, E, and applied stress, $\sigma$, is related to the elongation or strain, $\epsilon$(the maximum cord stretch divided by the un-stretched cord length), in the following relation: $E=\sigma/\epsilon$. Therefore, the elongation is inversely proportional to the elastic modulus, so as the modulus increases for the same stress level, the corresponding elongation will be proportionately reduced.

It should also be noted that the modulus of any particular sized cord can be increased by packing the rubber tighter. Furthermore, as a general rule, the harder the cord, the greater will be the modulus. Varying the ratio of yarn to rubber also controls the modulus, which may be achieved, for example, by using multiple covering layers. Such bungee cords may be available from many manufacturers, including, for example, HNW Company "The Elastic People," which is located in Pawtucket, R.I. (see http://www.hnwelastic.com/index.htm).

Figure 5:
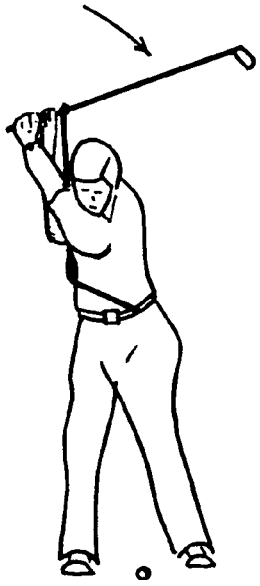
FIG. 5 is a front view of a golfer using the golf swing training device of FIG. 1, while the golf club is at the top portion of the upswing.
Figure 6:
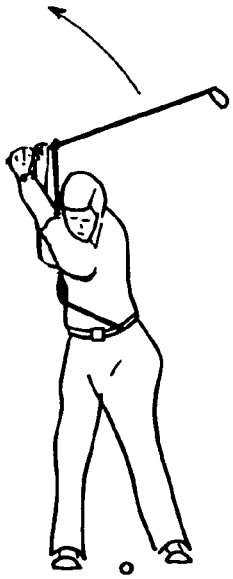
FIG. 6 is a front view of a golfer using the golf swing training device of FIG. 1, while the golf club is at the top portion of the downswing.
Figure 7:
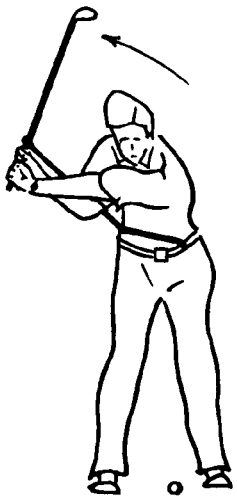
FIG. 7 is a front view of a golfer using the golf swing training device of FIG. 1, while the golf club is at the middle portion of the downswing.
Figure 8:
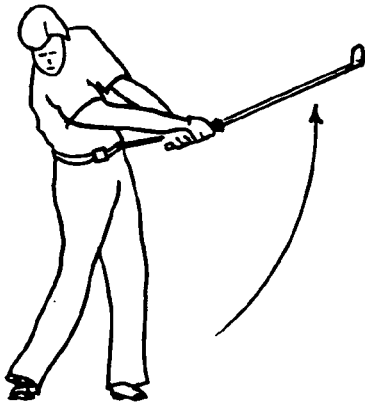
FIG. 8 is a front view of a golfer using the golf swing training device of FIG. 1, while the golf club is at the follow-through portion of the downswing.

The second cord portion 50*ii* may also be a pre-stretched cord, so that as the golfer reaches the full backswing position shown in FIG. 5, the golfer may feel a 'bounce' indicating that he has reached a full back swing position, and needs to accelerate into the downswing phase. Repetitive backswings and downswings serve to create muscle memory of this feeling of slowing down and controlling the backswing in preparation for reversing direction for a smooth, 'on-plane' downswing, particularly at the crucial part of the swing. Both of the cord portions, 50*i* and 50*ii*, serve to create tension energy at the top of the back swing, however, the pre-stretched second portion 50*ii* may provide the substantial portion of the initial energy for training the reversal of direction.

Attachment of the loop 50A of club attachment means 70 to the club shaft just below the user's grip has not heretofore been utilized in the prior art, and advantageously provides a lever arm effect, pulling the club rotation forward around the fulcrum of the wrist to serve as a training means for the correct rotational positioning of the club-head toward the ball as it is hit.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

I claim:

1. A golf swing training device, for use by a golfer to properly develop a golf swing and counter a tendency toward an overpowered back-swing resulting in an uncontrolled out-of-plane downswing, while simultaneously training correct club rotation during a downswing, said golf swing training device comprising:

a strap, said strap having a first end and a second end;

a latch plate, said latch plate being adjustably securable in proximity to said strap first end;

a latch, said latch being secured to said second end of said strap and being configured to releasably receive a portion of said latch plate;

at least one bungee cord, said at least one bungee cord having a first end and a second end, said first end of said at least one bungee cord being attached to said strap at a position relative to said latch, said at least one bungee cord further comprising a first cord portion and a second cord portion being joined to said first cord portion, said first cord portion having a first elastic modulus, and said second cord portion having a second elastic modulus, said second elastic modulus being greater than said first elastic modulus; and a cinching apparatus, said cinching apparatus being located proximate to said second end of said at least one bungee cord, and being configured for cinching of said at least one bungee cord around a portion of the shaft of the golf club to be on or proximate to the grip at a position being distal from the end of the shaft, to provide a lever-arm effect to counter a tendency toward an overpowered backswing and maintain a controlled in-plane downswing, and to pull the club rotation forward around the fulcrum of the wrist to simultaneously train correct club rotation during the downswing.

2. The golf swing training device according to claim 1, wherein said cinching apparatus cinches said at least one bungee cord around the shaft of the golf club at a position being just below the end of the grip, with said at least one bungee cord extending generally upwardly from the shaft.

3. The golf swing training device according to claim 2, wherein said cinching apparatus comprises a housing, and a button disposed therein being spring biased to cause a portion of said button to engage a portion of said at least one bungee cord against said housing, to releasably inhibit relative movement therebetween.

4. The golf swing training device according to claim 3, wherein said bungee attachment position on said strap being relative to said latch comprises a position being in the range of 0 to 9 inches to either side of said latch.

5. The golf swing training device according to claim 4, wherein said bungee attachment position on said strap being relative to said latch comprises a position being approximately 4 to 6 inches away from said latch.

6. The golf swing training device according to claim 4, wherein said bungee attachment position on said strap is disposed on the left side of said strap for a right-handed golf swing, and is disposed on the right side of said strap for a left-handed golf swing.

7. The golf swing training device according to claim 6, wherein said second cord portion is pre-stretched.

8. The golf swing training device according to claim 7, wherein said first cord is configured to reach full elongation at a position being part way to the end of the backswing, and wherein said pre-stretched second cord is configured to elongate to cause a bounce at the end of the backswing.

9. The golf swing training device according to claim 8, wherein said second end of said at least one bungee cord is looped around within said cinching apparatus to permit adjustments to an effective length of said at least one bungee cord.

10. A golf swing training device, for use by a golfer to properly develop a golf swing and counter a tendency toward an overpowered back-swing resulting in an uncontrolled out-of-plane downswing, while simultaneously training correct club rotation during a downswing, said golf swing training device comprising:

a strap, said strap having a first end and a second end;

a latch plate, said latch plate being adjustably securable in proximity to said strap first end;

a latch, said latch being secured to said second end of said strap and being configured to releasably receive a portion of said latch plate;

at least one elastic resistance band, said at least one elastic resistance band having a first end and a second end, said first end of said at least one elastic resistance band being attached to said strap at a position relative to said latch, said at least one resistance band further comprising a first elastic band portion and a second elastic band portion being joined to said first elastic band portion, said first elastic band portion having a first elastic modulus and said second elastic band portion having a second elastic modulus, said second elastic modulus being greater than said first elastic modulus; and a cinching apparatus, said cinching apparatus being located proximate to said second end of said at least one elastic resistance band, and being configured for cinching of said at least one elastic resistance band around a portion of the shaft of the golf club being on or proximate to the grip of the club at a position being distal from the end of the shaft, to provide a lever-arm effect to counter a tendency toward an overpowered backswing and maintain a controlled in-plane downswing, and to pull the club rotation forward around the fulcrum of the wrist to simultaneously train correct club rotation during the downswing.

11. The golf swing training device according to claim 10, wherein said cinching apparatus cinches said at least one elastic resistance band around the shaft of the golf club at a position being just below the end of the grip, with said at least one elastic resistance band extending generally away from the side of the shaft.

12. The golf swing training device according to claim 10, wherein said cinching apparatus comprises a housing and a button slidably disposed therein being spring biased to cause a portion of said button to engage a portion of said at least one elastic resistance band against said housing to releasably inhibit relative movement therebetween.

13. The golf swing training device according to claim 10, wherein said bungee attachment position on said strap being relative to said latch comprises a position being in the range of 0 inches to 18 inches away from said latch.

14. The golf swing training device according to claim 13, wherein said resistance band attachment position on said strap being relative to said latch comprises a position being approximately 4 to 6 inches away from said latch.

15. The golf swing training device according to claim 10, wherein said elastic resistance band attachment position on said strap is disposed on the left side of said strap for a right-handed golf swing, and is disposed on the right side of said strap for a left-handed golf swing.

16. The golf swing training device according to claim 10, wherein said second elastic band portion is pre-stretched.

17. The golf swing training device according to claim 16, wherein said first elastic band portion is configured to reach full elongation at a position being part way to the end of the backswing, and wherein said pre-stretched second elastic band portion is configured to elongate to cause a bounce at the end of the backswing.

18. The golf swing training device according to claim 10, wherein said second end of said at least one elastic resistance band is looped around within said cinching apparatus to permit adjustments to an effective length of said at least one elastic resistance band.

19. A golf swing training device, for use by a golfer to properly develop a golf swing and counter a tendency toward an overpowered back-swing resulting in an uncontrolled out-of-plane downswing, while simultaneously training correct club rotation during a downswing, said golf swing training device comprising: a strap, said strap having a first end and a second end; a latch plate, said latch plate being adjustably securable in proximity to said strap first end; a latch, said latch being secured to said second end of said strap and being configured to releasably receive a portion of said latch plate; at least one bungee cord, said at least one bungee cord having a first end and a second end, said first end of said at least one bungee cord being attached to said strap at a position being in the range of 0 to 9 inches to either side of said latch, said bungee attachment position on said strap being disposed on the left side of said strap for a right-handed golf swing, and being disposed on the right side of said strap for a left-handed golf swing, said at least one bungee cord further comprising a first cord portion and a second cord portion being joined to said first cord portion, said first cord portion having a first elastic modulus, and said second cord portion having a second elastic modulus, said second elastic modulus being greater than said first elastic modulus; and a cinching apparatus, said cinching apparatus being located proximate to said second end of said at least one bungee cord, and being configured for cinching said at least one bungee cord around the shaft of the golf club at a position being just below the end of the grip with said at least one bungee cord extending generally upwardly from the shaft, to provide a lever-arm effect to counter a tendency toward an overpowered backswing and maintain a controlled in-plane downswing, and to pull the club rotation forward around the fulcrum of the wrist to simultaneously train correct club rotation during the downswing, said cinching apparatus comprising a housing and a button disposed therein being spring biased to cause a portion of said button to engage a portion of said at least one bungee cord against said housing, to releasably inhibit relative movement therebetween.

* * * * *